US005938158A

United States Patent [19]

Tisbo

[11] Patent Number: 5,938,158

[45] Date of Patent: Aug. 17, 1999

[54] DESKTOP SUPPORT STRUCTURE

[75] Inventor: Peter M. Tisbo, Barrington, Ill.

[73] Assignee: Custom Plastics, Inc., Ill.

[21] Appl. No.: 08/858,746

[22] Filed: May 19, 1997

Related U.S. Application Data

[63] Continuation-in-part of application No. 08/620,416, Mar. 22, 1996.

[51] Int. Cl.[6] ..... A47B 96/06

[52] U.S. Cl. ..... 248/228.3

[58] Field of Search ..... 248/228.3, 231.41

[56] References Cited

U.S. PATENT DOCUMENTS

| | | | |
|---|---|---|---|
| 846,926 | 3/1907 | Kraus | 248/231.41 |
| 2,935,118 | 5/1960 | Meilleur | 248/231.41 |
| 3,774,773 | 11/1973 | Brent | 248/231.41 |
| 5,775,654 | 7/1998 | Price | 248/231.41 |

*Primary Examiner*—Alvin Chin-Shue
*Assistant Examiner*—Sarah Purol
*Attorney, Agent, or Firm*—McHale & Slavin

[57] ABSTRACT

A office organizational apparatus constructed of interlocking slat wall sections. Each individual slat is T-shaped for receiving one or more hooks incorporated on the mounting side of organizational accessories. These accessories are removably placed on the slatwall as needed and positioned upon consumer preference. The apparatus also includes a wire chase assembly attached to the bottom of the slat wall sections for receiving and organizing wires running along the desk. The slat wall sections and chase are encompassed in a frame structure which is supported by vertical members attached to the edge of a desk via clamps or directly to a wall.

26 Claims, 7 Drawing Sheets

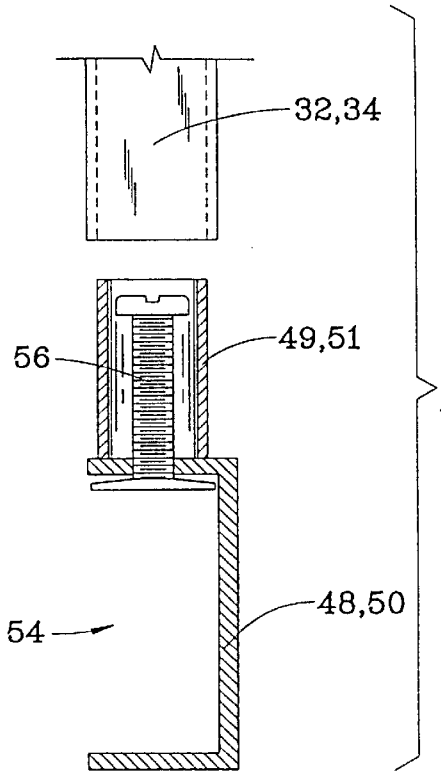
FIG. 3
FIG. 5
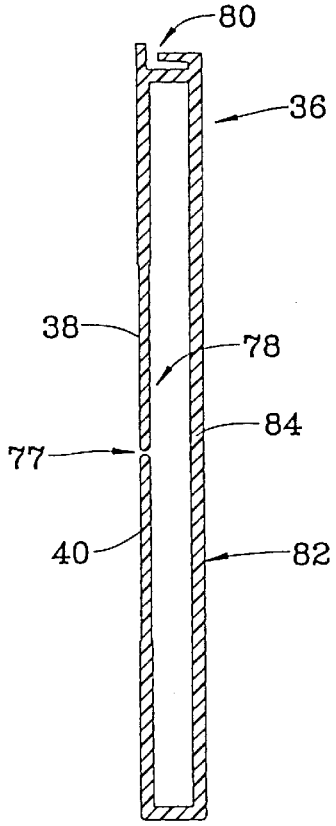
FIG. 6
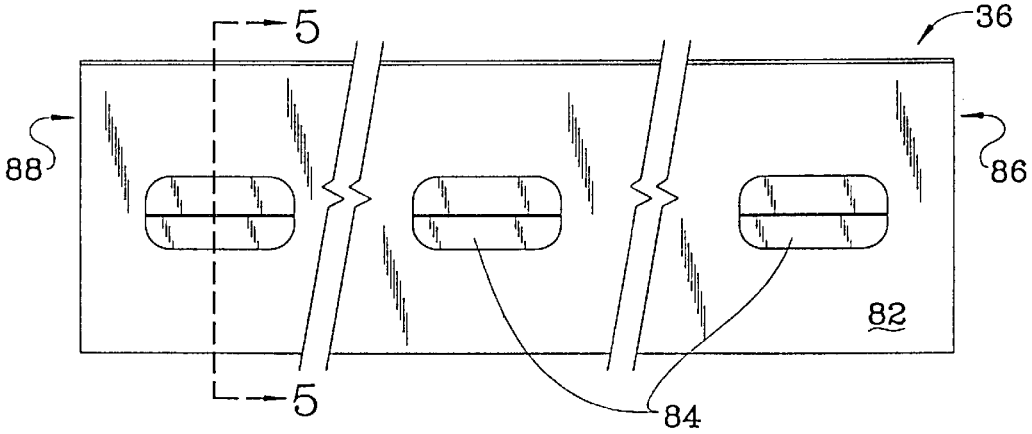

DESKTOP SUPPORT STRUCTURE

This application is a continuation-in-part of copending application Ser. No. 08/620,416 filed on Mar. 22, 1996.

FIELD OF THE INVENTION

This invention relates to organizers and in particular to an organizing device for use in an office setting.

BACKGROUND OF THE INVENTION

Office organization is a concern of both employers and employees. With office space at a premium, organization becomes a necessity to prevent misplacement of important items. A desk, being the primary working surface,for individuals in an office, becomes the primary focus for any type of organization. While a cluttered desk may be an indication of poor organization, an otherwise organized individual having limited desk space may be forced into such disarray. Even if an employee is conscientious of the clutter, concealment of important documents in drawers or file cabinets may cause the same type of problems as poor organization. Accordingly, an individual having a small desk faces a dilemma in maintaining an organized desk versus maintaining all important items in a readily available fashion.

The available desk top space is further lessened by devices as large as computers placed on the desk top together with telephones, dictaphones, and so forth. In addition, peripheral items such as a computer monitor, mousepad and mouse, lamp, file tray, stapler, books, and so forth all cause loss of working space. In addition, the computer may require compact discs or floppy diskettes, that must be readily available. Moreover, a myriad of wires typically runs along the top and bottom of a desk to accommodate the aforementioned items leading to an aesthetically unpleasing array that can be unsafe.

A desk may include drawers for placement of pens, pencils, notepads, hanging files, and so forth. The more drawer space, the less available leg room. Moreover, while the individual may conceal items within a drawer, the individual may also forget where an item was placed.

Prior art devices assist in desk organization, but detract from desk top surface space. Such devices include stackable trays and writing instrument holders which all take up space on the desk as well as add clutter to a desk. This can be compounded when pendaflex hanging folders are used which cannot be stored on a desktop. Another common desk organizer is the multiple level paper tray which provides separated bins for purposes of organizing. This also utilizes valuable desk space.

Another form of organizing is use of a wall for holding miscellaneous items. If a desk is positioned against a wall, a corkboard structure may be secured to the wall to assist in organization of loose leaf papers. However, office practice shows that such boards often add to the cluttered appearance of the desk. In addition, many companies are making a more efficient use of floor space by eliminating individual offices and requiring the employees to work with desks placed in an open room. In this environment there is no access to a wall unless the space is divided by cubicles which further add to the expense of an office.

Thus, what is lacking in the art is an office organizer that will maintain items in close proximity to the working surface of a desk, yet allow for positioning of such items away from the surface of the desk. This organizer should include accessories for holding and organizing such things as flat files and papers, hanging files, writing utensils, computer accessories, telephone, and related wiring.

SUMMARY OF THE INVENTION

The office organizer, according to this invention, provides an inexpensive storage device having a particular advantage in maintaining items above the surface of a desk. The organizer utilizes an extendible wall that may be coupled to a wall or desk employing horizontally disposed slats that allow for engagement of various organizational accessories. The modular and removable nature of these organizational accessories allows the individual to customize a workspace while maintaining the surface of the desk in a useable manner.

The organization device, to be referred to as a slat wall, provides for the attachment of various organizational accessories having hanging brackets allowing for the raised support of pendaflex files, telephone, dictaphone, computer discs, paper tray holders, and a holder for writing tools such as pens and pencils. When coupled to a desk, the organizer provides a wall that allows an individual to maintain a certain amount of privacy.

The slat wall is constructed of lightweight plastic preferably framed allowing the structure to be fixed to a mounting surface such as a desktop or wall. For instance, the frame may include a coupling fixture with an adjustable clamp assembly such as a C-shaped section that allows for securement to a desk. Vertical support members can then be secured to the top of each assembly. Alternatively, the frame may be secured directly to an adjoining wall wherein framing structure includes provisions for proper securement.

The slat wall is further defined by spaced apart slats having a unique detent which allows for the hanging receipt of an accessory. This detent is formed from a T-shaped cross-sectional shape which allows for an accessory having a reciprocating hanging mechanism to be placed along the vertical or longitudinal length of any slat.

The organizer may also include a wire chase which is secured along the bottom of the slat wall. This receptacle provides a flexible set of flaps for receiving and concealing wires run along the length of the device. The back of the chase has a plurality of openings for accommodating various device plugs. Hence, this chase serves to conceal unsightly and dangerous tangles of wires.

Accordingly, an objective of the present invention is to disclose an office organizer providing a slat wall member that allows for the personalized securement of various organizing support trays and containers.

Yet another objective of the present invention is to disclose an aesthetically pleasing organizer for attachment to a desk top which allows an individual to maintain a form of individualism in the organization of their desk, yet provides sufficient surface area so as to optimize the available desk top work space.

Still another objective of the present invention is to provide an organizer which may consist of movable file holders, storage bins, computer disk holders and so forth, as to match an individual's particular working environment and needs.

Yet another objective of the present invention is to provide a desk top organizer which includes a wire chase for concealing and organizing cords associated with desk top devices.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

BRIEF DESCRIPTION OF THE DRAWINGS

FIG. 3 shows a cross-sectional view of the example C-shaped desk clamp and frame supporting assembly along cut 3—3 of FIG. 2.

FIG. 5 shows a cross sectional view of the wire chase which can be attached to the bottom of the slat wall section.

FIG. 6 shows the back view of the wire chase assembly of FIG. 5.

DETAILED DESCRIPTION OF THE PREFERRED EMBODIMENT

Figure 1:
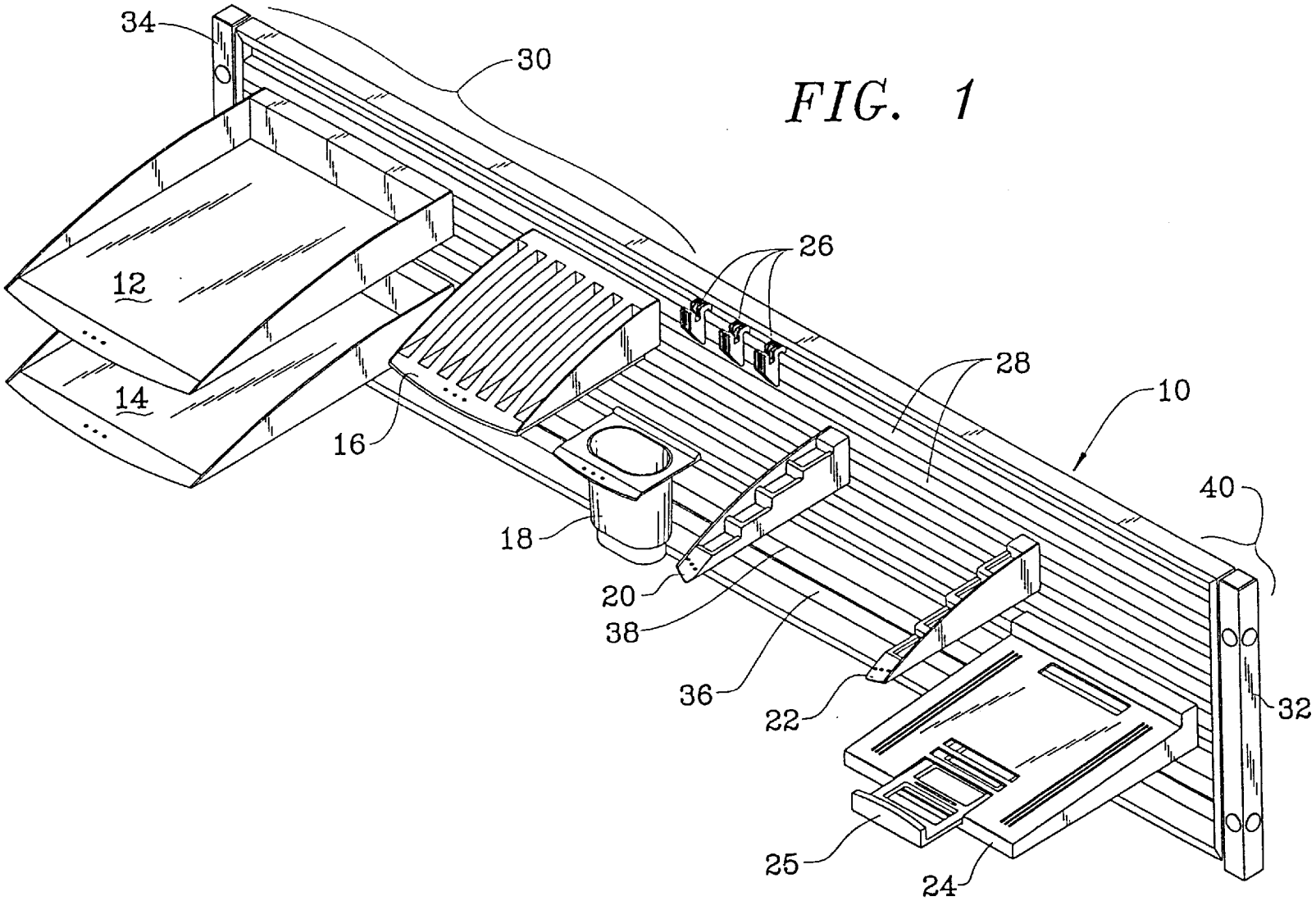
FIG. 1 shows a pictorial view of the desk organizer of the present invention, as attached to a framing and vertical support structure, with various accessories attached to the slat support wall.

It is to be understood that while a specific embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

Referring now to FIG. 1, the organizer 10 of the instant invention is illustrated with a variety of organizational accessories attached. These accessories include a pair of horizontally oriented paper/file trays 12 and 14, a CD holder 16, a receptacle cup 18 for pencils, pens, paperclips, etc., a pair of hanging folder arms 20 and 22, a telephone support stand 24, and a set of retaining hooks 26. The telephone support stand 24 further includes an adjustable retaining wall/clip 25. Each accessory includes an attachment means in the form of a clip, or plurality of clips, each of which interfaces with the horizontally oriented slats 28 on the vertical support wall 30 (see FIG. 4). The support wall 30 can be attached to a vertically oriented support frame comprised of vertical support members 32 and 34. These support members may then attach to individualized support bases.

The support wall 30 can include a wire chase 36 which runs along the length of the wall 30. This wire chase 36 attaches to the lower most slat on the support wall 30 and serves as a channel for running wires along the length of the desk. The exposed front of the chase 36 includes parallel flexible flaps 38 which can be flexed inward to receive wires and/or plugs. Accordingly, the wire chase 36 serves as a conduit for wires running between equipment and wires running to wall plugs.

Figure 2:
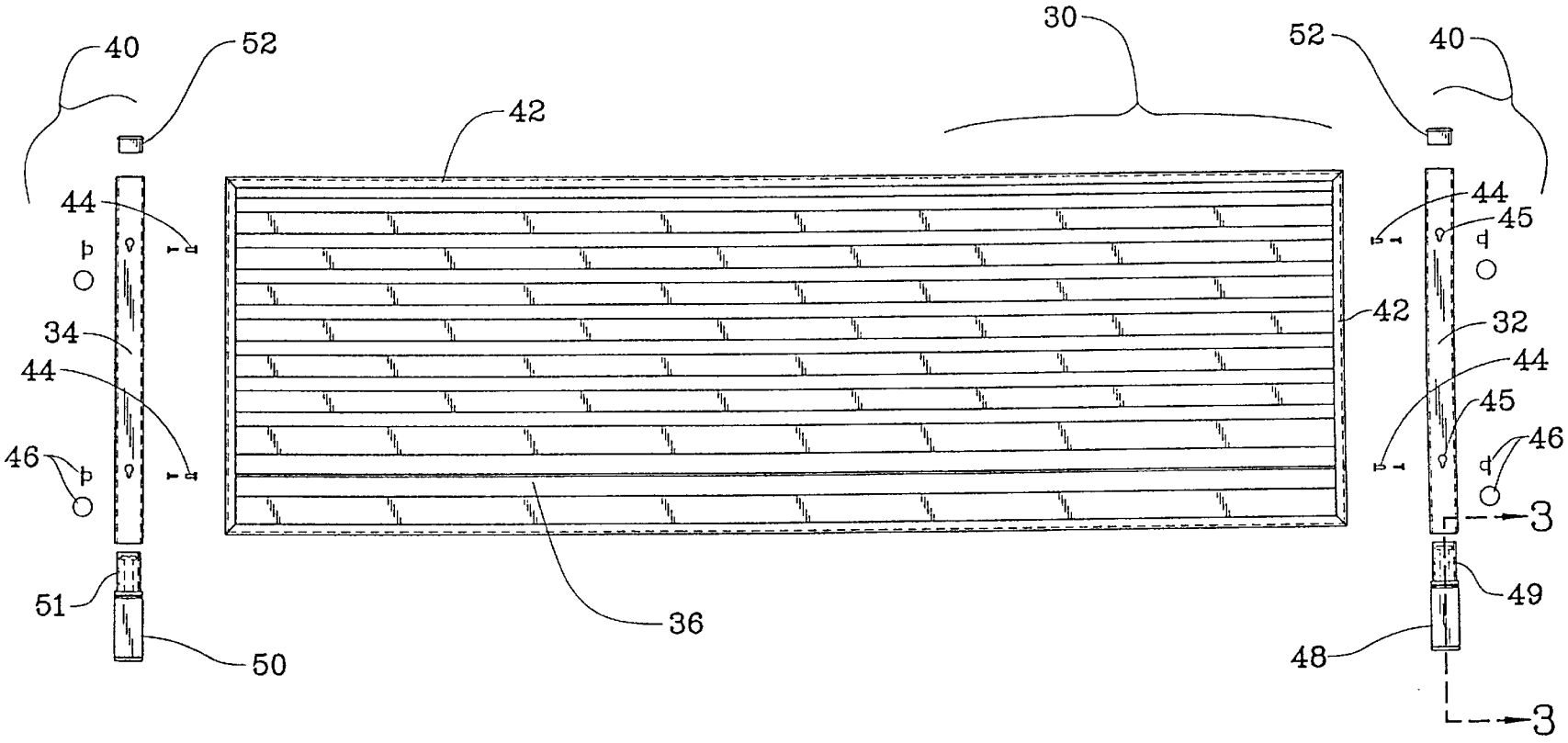
FIG. 2 shows a front view of the slat support wall as surrounded by the framing structure, with the vertical support structure shown to the sides in exploded fashion.

Referring now to FIG. 2, a more detailed frontal view of the slat support wall 30 is shown with various components of the vertical support fixture 40 depicted in exploded fashion. The fixture 40 is comprised of a frame 42 which encompasses the assembled slat wall sections and attached wire chase section. The fixture 40 also includes a pair of vertical support members 32 and 34 which attachably secures the frame in vertical orientation via attachment means 44. This attachment means 44 typically includes attachment pins as shown. The vertical support members 32 and 34 generally have a square cross-sectional area and have a plastic endcap 52 to protect against exposure to sharp edges on vertical support members 32 and 34. The outer sides include possible attachment points 45, with associated protective caps 46, for affixing the support members to a wall, possibly behind or near a desk. Alternatively, the organizer might be mounted as a stand alone organizer without coupling to a desk.

This embodiment shows a removable mounting means for clamping to the overhanging edge of a desk, table, or other similar piece of furniture. When mounted to a desk, this removable fixture 40 employs a pair of C-shaped clamp assemblies 48 and 50 which attach to the edge of a desk. The members 32 and 34 then mountably attach to the vertical mounts 49, 51 on the C-clamp assemblies.

FIG. 3 illustrates a cross-sectional view of the example clamping assemblies 48 and 50 which might be used to removably secure the wall apparatus to a desk. Each assembly includes a mounting cavity 54 and a mounting screw 56 which clamps down upon the edge or lip of a desk or table, not shown. Upon affixing the clamps 48 and 50, the vertical support members 32 and 34 are fitted over the top of the mounting assemblies 49 and 51. The mounting assemblies generally extend upwards a sufficient amount to insure a secure fit and a stable mounting platform for the framed slat support wall 30. Alternatively, the assemblies 48 and 50 could be constructed to allow the vertical support members 32, 34 to fit inside corresponding mounting slots, not shown on the assemblies 48, 50. Such mounting assemblies will suffice as long as they provide adequate vertical support against the wall swaying in the mount. This disclosure provides the aforementioned example embodiments and includes related equivalents thereof.

Figure 4:
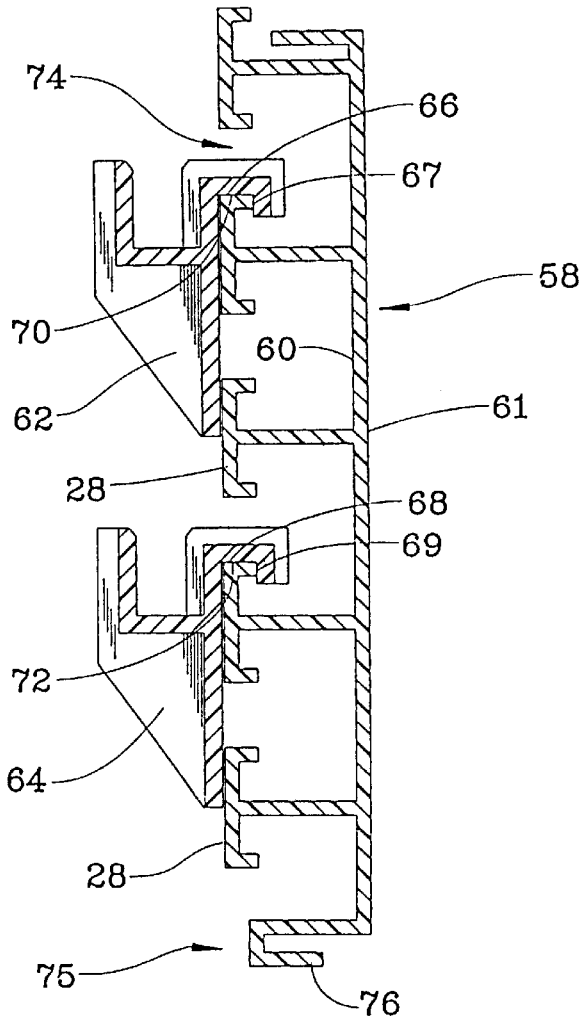
FIG. 4 shows a cross sectional view of a slat wall section with a pair of accessory hooks suspended from the slat forming T-shaped receiving aperture.

Referring now to FIG. 4, a cross sectional view of a slat wall section 58 is shown. Each section includes a front side 60, a back side 61, a first end 75, and a second end 81, and each section has opposing sides 86 and 88 (See FIG. 6). Each slat 28 consists of a T-shaped protrusion or fixture which is extruded or attached to the front side 60 of wall section 58. A pair of accessory hooks 62 and 64 are fitted over each T-shaped slat 28 so that the mounting hooks 66, 68 fit over a portion of the T-shaped slat and lock the accessory hook into place. As weight is placed upon the accessory hook 62 and 64, the mounting hook 66 is further held in place as the protrusion 67 and 69 hooks firmly against the T section 70 and 72. At the same time, the back of the accessory hook 62 braces firmly against the front of the slat 28. If removal of the accessory hook 62 or 64 is necessary, the hook is lifted upwards so that protrusion 67 clears T section 70 and the accessory hook is maneuvered out channel 74 formed between the slats 28.

While not shown for each device, it should be noted that each of the aforementioned organizational accessories employs similar mounting hooks for attaching to the slat section. Organizational accessories such as the receptacle cup typically employ 2 hooks, while the wider accessories such as the paper/file tray generally employ 3 hooks. Such hooks allow easy, yet secure, placement and replacement of organizational accessories on the slat wall. Moreover, such movement can include sliding the accessories from side to side along the length of the slat.

Figure 4A:
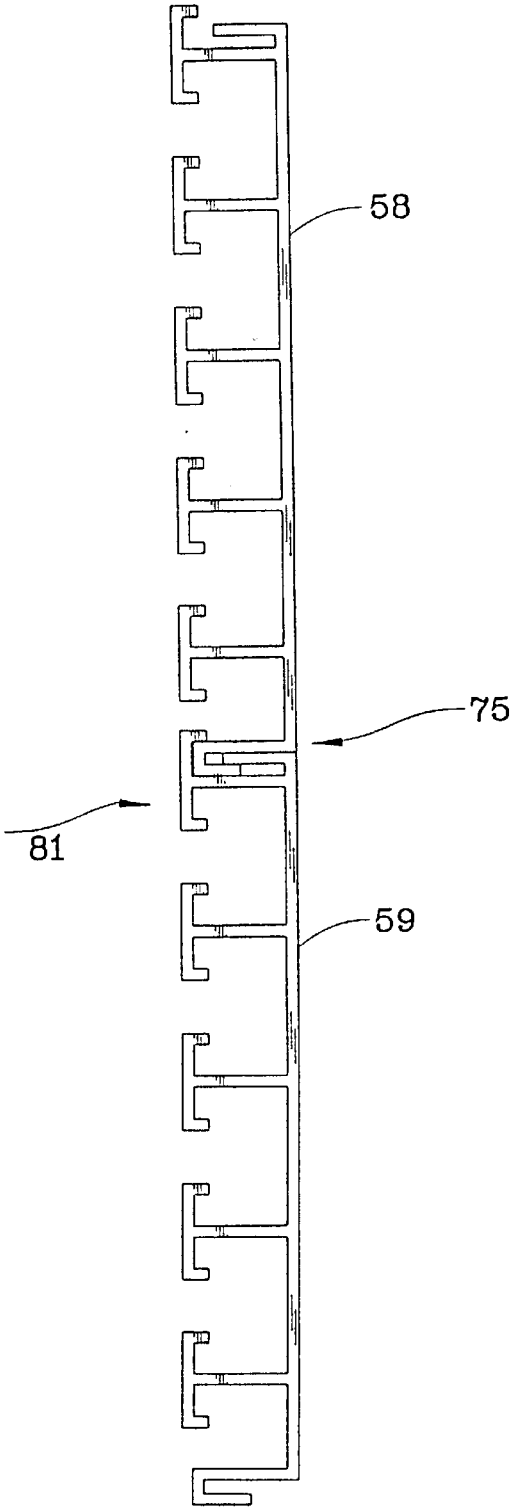
FIG. 4A shows a pair of slat wall sections connected together.

Each slat wall section 58 is designed to connect to a similar section in order to create a taller support wall, if needed. This would require a taller frame 42, and taller vertical support members 32 and 34 in order to facilitate the taller wall section. For such interconnectability, the first end of the wall section 58 has a frontward extending tab or J-shaped flange 76 which directly interconnects with the T-shaped slat 28. Referring now to FIG. 4A, the slat wall section 58 is shown interconnected with a second, identical slat wall piece 59.

Referring now to FIG. 5, a cross-sectional view along cut 6—6 (see FIG. 6) of a wire chase or receptacle 36 is shown which is attached to the J-shaped flange 76 on the first end 75 of the lowermost wall section. This attachment is achieved by inserting the protrusion 76 into the similarly shaped attachment receptacle 80 on the upper end of the wire chase 36. Once attached, the wire chase 36 serves as a receptacle and/or conduit for wires which run to and from various equipment on the desk and on the organizer accessories. The cords, not shown, are pushed through the opening 77 formed between the upper flexible flap 38 and the lower flexible flap 40 on the exposed front of the wire chase 36.

Referring now to FIG. 6, the back surface 82 of the wire chase 36 is shown. This surface includes a plurality of openings 84 which allow electrical or other types of plugs to pass through the back of the wire chase 36. Hence, wires from a device sitting on one edge of the desk can be run through the cavity 78 in the wire chase 36. This keeps such wires off the desk or off the floor and serves to clean up the frontal appearance of a desk, and to provide a safer storage place for such wires.

Figure 7:
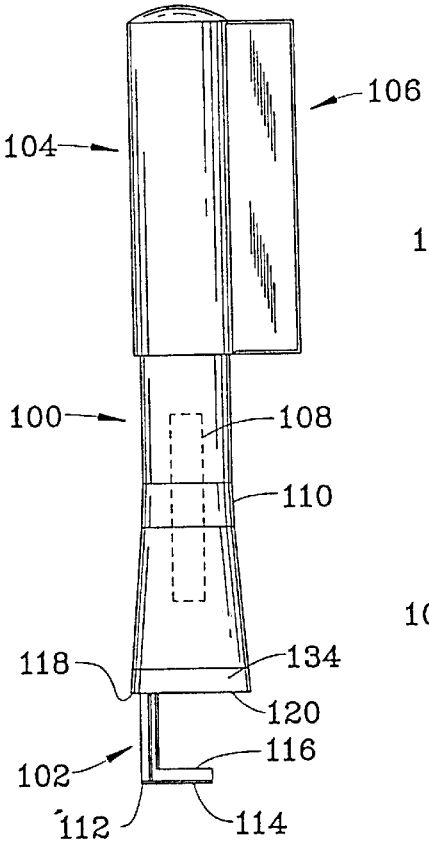
FIG. 7 is a side view of a second embodiment of a desk clamp and frame supporting assembly.

Now referring to FIG. 7, set forth is an alternative embodiment providing a support member for securing the slat wall structure to furniture, namely a desktop. In this embodiment, the means for securing the support member is defined as an upright structural housing 100 having an adjustable clamp portion 102 which positions the housing 100 in an upright position in relation to a desktop, and an adjustable securement portion 104 for aligning an attachment socket 106 to the slat wall structure support member.

The adjustable clamp portion 102 is adjustable over a variety of desktop thicknesses. A threaded bolt, depicted by hidden line 108, provides the range of adjustment through its engagement with a holding nut positioned within nut securement area 110. The adjustable clamp is coupled to the threaded bolt and raised and lowered in relation to the nut securement 110 area providing a range of adjustment equal to the length of the threaded bolt. Vertical leg 112 extends downwardly from the bottom 118 of end cap 134 with an engagement tab 114 formed perpendicular thereto. The engagement tab 114 incorporates an engagement surface member 116 for use in frictionally engaging the lower surface of a desktop. The bottom 118 of the end cap 134 also incorporates an engagement surface member 120 formed from rubber or the like material to securely position the structural housing 100 once positioned. The overall height $H_1$ of the device is approximately 15 inches, with the adjustment securement portion having a height $H_2$ of approximately 7.25 inches. The end cap 135 has a height $H_3$ of approximately 0.5 inches.

To position the device, the structural housing 100 is opened by first rotating the housing while the adjustable clamp portion 102 is held in a fixed position, allowing the threaded shaft 108 to rotate through securement nut causing the spatial distance between the clamp and the end cap to be enlarged. Once the clamp area is enlarged, the clamp is placed over the edge of a desk and held in a fixed position while the structural housing is rotated so as to cause closure between the engagement surface supports. The structural housing can be tightened as necessary by retraction of the adjustable clamp portion into the structural housing, thereby causing frictional engagement of surface support 116 on the lower surface of the desk lip with engagement surface support 120 contacting the upper surface of the desk. The securement causes the structural housing to be forced into a rigid upright position wherein the adjustable socket 104 is used to engage and secure slat wall framing structure. The adjustable securement portion 104 may be raised or lowered to accommodate a particular placement with the attachment socket 106 used for directly engaging the slat wall support structure. Unique to this invention is the concealment of the clamp portion within the structural housing providing an aesthetically pleasing support stand that will not distract from the desktop appearance.

Figure 8:
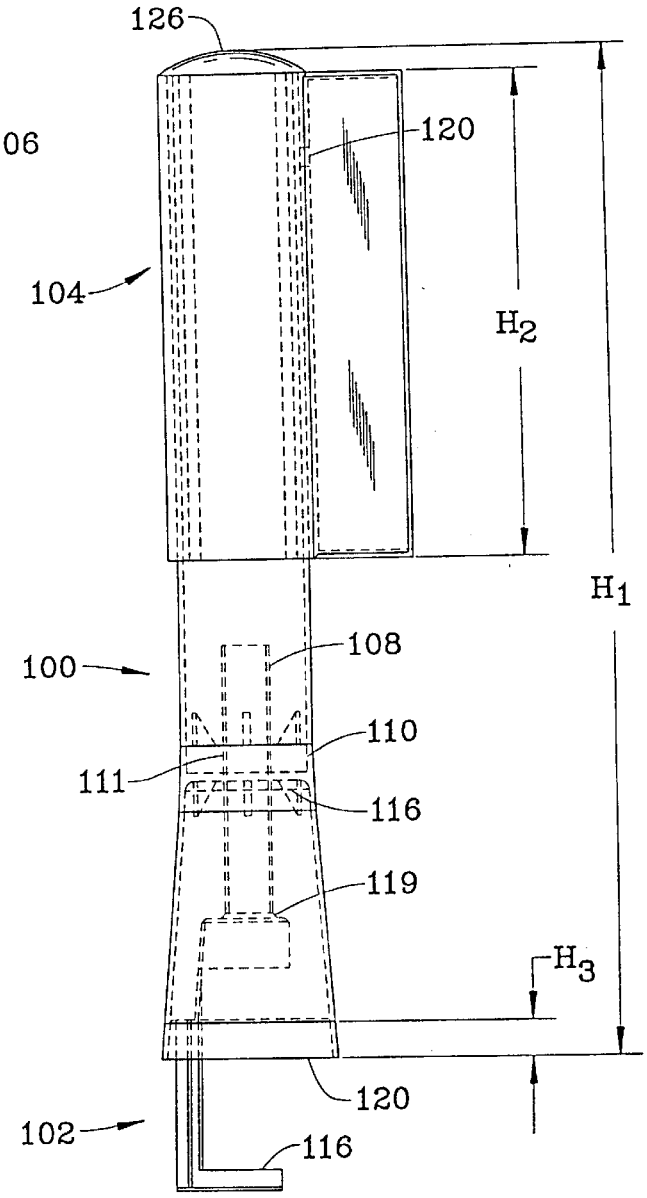
FIG. 8 is a cross-sectional side view of FIG. 7.

Referring now to FIG. 8, set forth is a cross-sectional side view of the structural housing 100 wherein the adjustable clamp portion 102 is shown coupled to threaded shaft 108 which threadingly engages securement nut 111. The lower portion of the structural housing 100 is enlarged allowing for the free rotation of adjustable clamp 102. The securement nut 111 is mounted within the nut securement area 110 having a preformed seat formed integral to the housing which frictionally engages the securement nut 111. The threaded bolt 108 is mounted to the clamp 102 at the clamp's top surface 119 which allows the clamp to rotate upwards until the surface 119 engages the bottom surface 116 of the nut holder 110. Similarly, the threaded shaft 108 may rotate downward as long as the threaded shaft engages the threads of the securement nut 111, thereby allowing a large spatial distance for purposes of clamping to the edge of a desk.

The adjustable securement portion 104 is slidably attached to the structural housing 100 to allow for rotation as well as vertical positioning to allow for the correct attachment to the slat wall housing structure. Aperture 120 allows for the expulsion of air trapped within the structural housing when the adjustment securement portion is raised or lowered.

Figure 9:
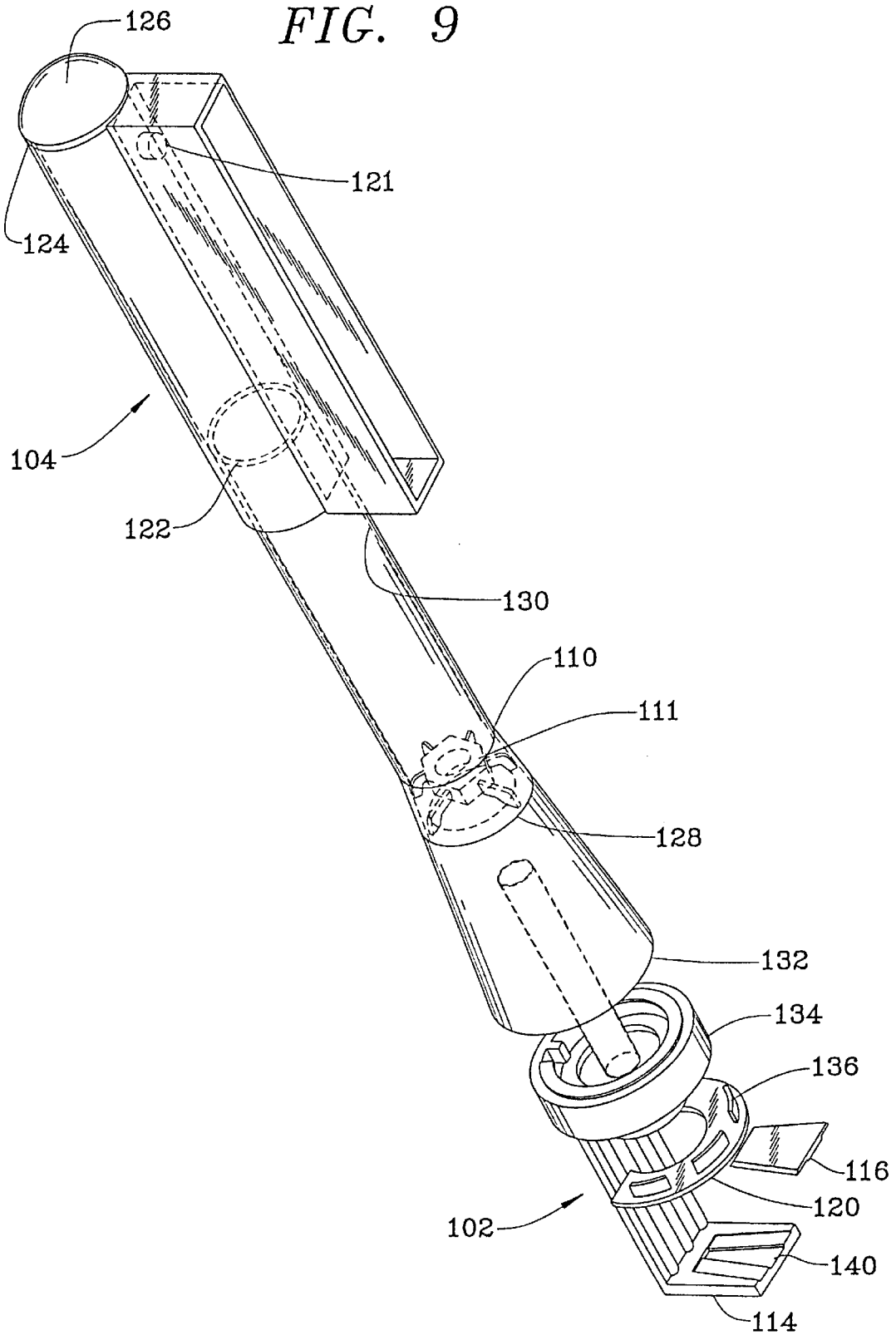
FIG. 9 is a cross-sectional perspective view of FIG. 7.

As shown in FIG. 9, the adjustable securement portion 104 is shown in a raised position over the structural housing 100 wherein upper end 122 is shown a distance from end 124 of the adjustable securement portion 104 to depict vertical adjustment. The adjustable securement portion 104 includes end cap 126 to prevent debris and like materials from entering the structural housing chamber. The nut holder 110 is formed from engagement tabs 128 for frictionally engaging the inner side wall 130 of the structural housing 100. The engagement tabs 128 secure the nut 111 in a fixed position wherein the threaded shaft 108 is placed through the securement nut 111 which allows for the adjustable positioning of the clamp portion 102.

The lower end 132 of the structural housing 100 is receptive to a modified end cap 134 which frictionally engages the inner surface 130 of end 132. The modified end cap 134 includes a rib causing the frictional engagement upon insertion to inhibit removal. The modified end cap is receptive to engagement surface 120 having tabs 136 operatively associated with the end cap 134. The engagement surface support may be formed of a frictionally engaging material such as rubber or soft plastic so as to prevent movement of the structural housing once the clamp is in position. Similarly, the engagement surface support 116 is formed from a frictionally engaging material and is slidably insertable into the receptacle 140 of the lower portion 114.

Figure 10:
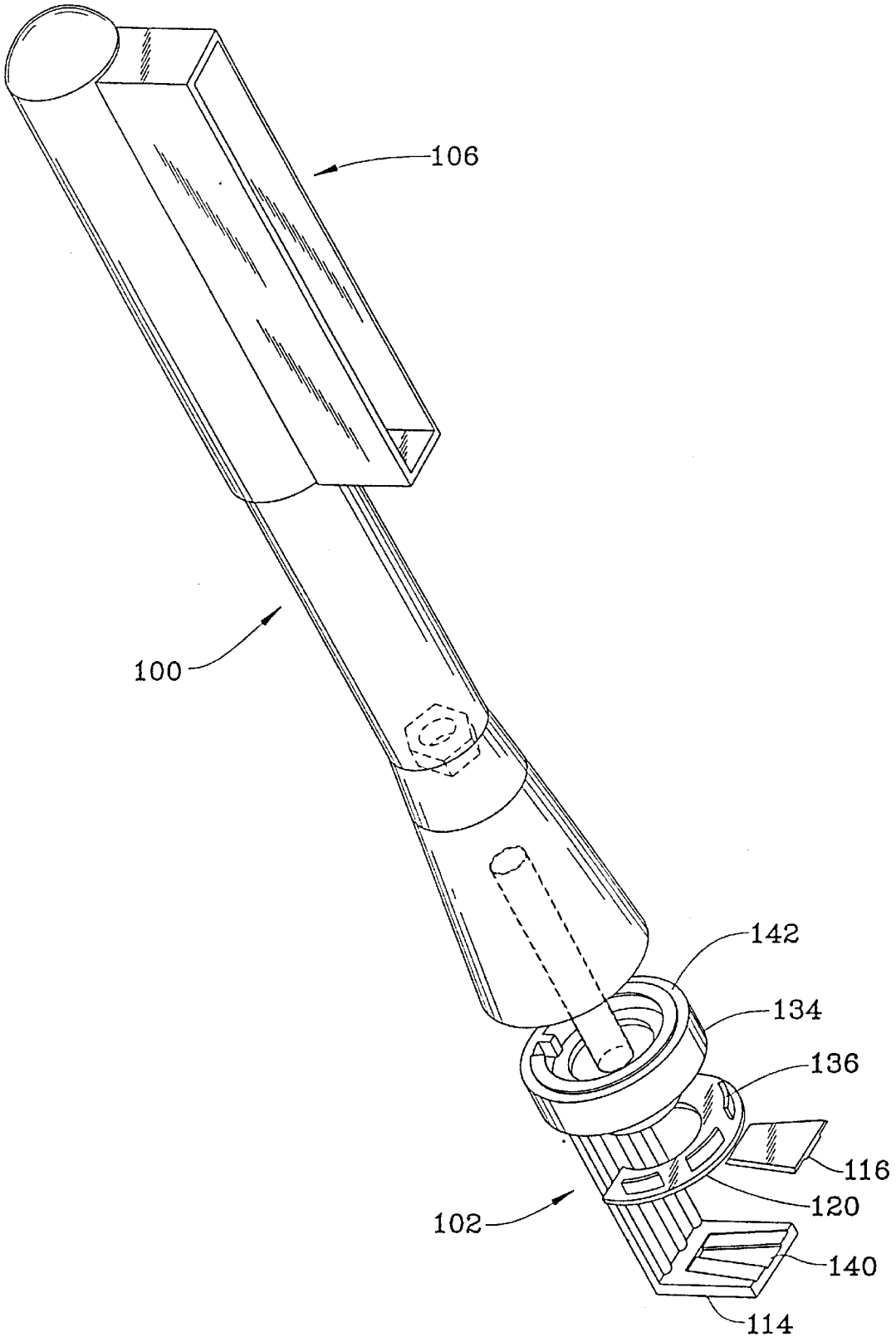
FIG. 10 is a perspective pictorial view of FIG. 9.

Now referring to FIG. 10, the modified end cap 134 is depicted in a pictorial illustration with rib 142 depicted and located along the top section of the modified end cap for engagement of the inner surface of structural housing 100. The engagement surface support 120 is shown with engagement tabs 136 operatively associated with the modified end cap 134. The engagement surface 116 is depicted for placement in support surface 140 of the adjustable clamp portion 114.

It is to be understood that while what is illustrated and described are certain forms of the invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What is claimed is:

1. A desktop support structure comprising:

a hollow structural housing having a first end and a second end, said second end including a removable end cap, said end cap having a friction engaging surface;

a rotatable attachment socket member coupled to said first end; and an adjustment clamp having a threaded shaft rotatable secured to a clamp nut holder placed within said structural housing and an L-shaped engagement surface extending outwardly from said second end of said structural housing, said clamp engagement surface operatively associated with said second end to form an adjustable opening therebetween;

whereby said support structure is placed in a rigid vertical position on the edge of a desktop with said second end of said structural member frictionally engaging the upper surface of said desktop with said clamp engagement surface frictionally engaging the lower surface of said desktop.

2. The desktop support structure according to claim 1 wherein said structural housing is tubular shaped.

3. The desktop support structure according to claim 2 wherein said second end of said structural housing is conically shaped providing an enlarged desktop engaging edge.

4. A desktop support structure comprising:

a hollow structural housing having a first end and a second end;

a rotatable attachment socket member coupled to said first end, said rotatable attachment socket member being slidable along a vertical length of said structural housing; and an adjustment clamp having a threaded shaft rotatable secured to a clamp nut holder placed within said structural housing and an L-shaped engagement surface extending outwardly from said second end of said structural housing, said clamp engagement surface operatively associated with said second end to form an adjustable opening therebetween;

whereby said support structure is placed in a rigid vertical position on the edge of a desktop with said second end of said structural member frictionally engaging the upper surface of said desktop with said clamp engagement surface frictionally engaging the lower surface of said desktop.

5. A desktop support structure comprising:

a hollow structural housing having a first end and a second end;

a rotatable attachment socket member coupled to said first end, said attachment socket member including an aperture fluidly communicated with said hollow structural housing to release air therefrom; and an adjustment clamp having a threaded shaft rotatable secured to a clamp nut holder placed within said structural housing and an L-shaped engagement surface extending outwardly from said second end of said structural housing, said clamp engagement surface operatively associated with said second end to form an adjustable opening therebetween;

whereby said support structure is placed in a rigid vertical position on the edge of a desktop with said second end of said structural member frictionally engaging the upper surface of said desktop with said clamp engagement surface frictionally engaging the lower surface of said desktop.

6. The desktop support structure according to claim 1 wherein said L-shaped tab includes a friction engaging surface.

7. An organizational apparatus comprising:

a support structure including at least one single-piece slat wall section, said slat wall section having a front surface, a rear surface, side edges, a top end, and a bottom end, said front surface having at least two spaced apart T-shaped members formed integral therewith and extending therefrom, each T-shaped member spanning between said side edges and including a spacing panel that abuts a support panel, said top end having a first linking tab, said bottom end having a second linking tab;

at least one organizational accessory having at least one hanger shaped to engage at least one of said T-shaped members; and a wire chase means for enclosing and guiding wires, whereby a first slat wall first linking tab will detachably couple with a corresponding second slat wall second linking tab when said first slat wall and said second slat wall are adjacent and coplanar.

8. The organizational apparatus of claim 7, wherein said support structure further includes:

a framing fixture that cooperates with said first linking tab and said second linking tab to allow a plurality of said slat wall sections to coupling within a single plane, said framing fixture bounding the perimeter of said plurality of said slat wall sections.

9. The organizational apparatus of claim 7, wherein said wire chase means includes a tube removably secured to said support structure, said tube having at least one wire insertion aperture and at least one wire exit aperture.

10. The organizational apparatus of claim 7, wherein each said second linking tab is further defined as an inverted J-shaped hooking fixture adapted to interlock with a corresponding one of said first linking tabs.

11. The organizational apparatus of claim 7, wherein said at least one organizational accessory hanger includes an L-shaped protrusion adapted to selectively engage one of said T-shaped members.

12. The organizational apparatus of claim 8, wherein said framing fixture comprises:

at least one rigid beam disposed along each said side edge, said top, and bottom ends of said slat wall sections;

a first vertical support member; and a second vertical support member, said vertical support members including connection means for securing said support members to a piece of furniture.

13. The organizational apparatus of claim 12, wherein at least one of said organizational accessories includes a pair of arms spaced apart to hold hanging file folders, each arm having at least one L-shaped protrusion horizontally disposed along one end of each said arm, said L-shaped protrusion adapted to engage one of said T-shaped members.

14. The organizational apparatus of claim 12, wherein at least one of said organizational accessories includes a receptacle, said receptacle having at least one L-shaped protrusion horizontally disposed along one end of said holder, said receptacle adapted to engage one of said T-shaped members.

15. The organizational apparatus of claim 12, wherein said vertical support members include a means for attaching said members to a vertical wall surface adjacent a supporting piece of furniture.

16. The organizational apparatus of claim 12, wherein at least one of said organizational accessories includes a means for holding a plurality of compact discs in a vertical position, said holder including at least one L-shaped protrusion horizontally disposed along one end of said holder, said L-shaped protrusion adapted to engage one of said T-shaped members.

17. The organizational apparatus of claim 12, wherein said connection means comprises:

at least one C-shaped clamp, said at least one adjustable clamp, said clamp including a tightening screw extending into said mounting assembly.

18. The organizational apparatus of claim 12, wherein said support members are fixedly attached to a piece of furniture.

19. The organizational apparatus of claim 12, wherein at least one of said organizational accessories includes a retaining hook having at least one L-shaped protrusion horizontally disposed along one end of said hook, said L-shaped protrusion adapted to engage one of said T-shaped members.

20. The organizational apparatus of claim 12, wherein at least one of said organizational accessories includes a paper tray having at least one substantially flat loading surface, said tray having an L-shaped protrusion horizontally disposed along one end of said tray, said protrusion adapted to engage one of said T-shaped members.

21. The organizational apparatus of claim 12, wherein at least one of said organizational accessories includes a telephone support platform, said platform having at least one L-shaped protrusion horizontally disposed along one end of said platform, said L-shaped protrusion adapted to engage one of said T-shaped members, said platform including a means for adjusting a longitudinal length of said platform.

22. An organizational apparatus comprising:

an organizing support wall made from at least one slat wall section having a plurality of parallel, spaced apart T-shaped support members with an upper surface of each T-shaped member available for receivably supporting organizational accessories;

means for coupling each said slat wall section to at least one coplanar adjoining slat wall section;

a wire chase means for concealing and guiding wires; at least one organizational accessory, each said accessory having at least one hanger for releasable coupling of said accessory to one of said T-shaped members;

a framing fixture for vertically supporting said slat wall; and a positioning means for maintaining said framing fixture in a vertical orientation.

23. The organizational apparatus of claim 22, wherein said organizational accessory hanger includes an L-shaped protrusion sized to selectively engage one of said T-shaped members.

24. The organizational apparatus of claim 7, wherein said support structure further includes a framing fixture bounding the perimeter of said slat wall section.

25. The organizational apparatus of claim 24, wherein said framing fixture is comprised of at least one rigid beam secured along each said side edge and said top and bottom ends of said at least one slat wall section; a first vertical support member and a second vertical support member, said vertical support members including connection means for securing said support members to a supporting piece of furniture.

26. The organizational apparatus of claim 25, wherein said framing fixture include a means for attaching said slat wall to a vertical wall surface.

* * * * *